US008597004B2

(12) United States Patent
Kiyokawa et al.

(10) Patent No.: US 8,597,004 B2
(45) Date of Patent: Dec. 3, 2013

(54) SCROLL TYPE COMPRESSOR HAVING AN INTERCOMMUNICATION PATH IN WHICH A PIN MEMBER IS INSERTED

(75) Inventors: Yasunori Kiyokawa, Moriguchi (JP); Tsutomu Kon, Moriguchi (JP); Katsuki Akuzawa, Moriguchi (JP); Kazuyoshi Sugimoto, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 180 days.

(21) Appl. No.: 12/709,071

(22) Filed: Feb. 19, 2010

(65) Prior Publication Data

US 2010/0215534 A1 Aug. 26, 2010

(30) Foreign Application Priority Data

Feb. 20, 2009 (JP) ..... 2009-037445

(51) Int. Cl.
*F03C 2/00* (2006.01)
*F04C 2/00* (2006.01)
*F04C 18/00* (2006.01)

(52) U.S. Cl.
USPC ..... 418/55.5; 418/55.1; 418/55.6; 418/57; 418/270

(58) Field of Classification Search
USPC ..... 418/55.1–55.6, 57, 270, DIG. 1
See application file for complete search history.

(56) References Cited

U.S. PATENT DOCUMENTS 4,518,324 A 5/1985 Mizuno et al.
4,702,683 A 10/1987 Inaba et al.
5,249,941 A 10/1993 Shibamoto
5,511,831 A 4/1996 Barton
6,186,556 B1 2/2001 Masuyama et al.
6,203,299 B1 * 3/2001 Williams et al. ..... 418/55.5
6,761,545 B1 * 7/2004 Witham et al. ..... 418/55.5
6,827,563 B2 12/2004 Hiwata et al.
7,134,853 B2 * 11/2006 Yamaji et al. ..... 418/55.5
2007/0145739 A1 6/2007 Haberl

FOREIGN PATENT DOCUMENTS

JP 50073025 U * 6/1975 ..... F16K 1/40
JP H1-163484 6/1989
JP 2001-304130 A 10/2001
JP 2002168183 A * 6/2002 ..... F04C 18/02

(Continued)

OTHER PUBLICATIONS

United States Office Action issued in U.S. Appl. No. 12/709,100 dated Jun. 27, 2012.

(Continued)

*Primary Examiner* — Theresa Trieu
(74) *Attorney, Agent, or Firm* — McDermott Will & Emery LLP

(57) ABSTRACT

A scroll type compressor including a fixed scroll, a movable scroll engaged with the fixed scroll and a hermetically sealed container, one of the fixed scroll and the movable scroll including an intercommunication path having a lower hole opened to the outside of the one scroll and an insertion hole formed by subjecting the lower hole to reaming processing from the one end to a position of a predetermined depth of the lower hole, a pin member that is slightly smaller in diameter than the intercommunication path and movably inserted in the intercommunication path, and a screw member that is provided at one end of the intercommunication path to close the one end of the intercommunication path so as to press the pin member against the end of the back side of the intercommunication path.

10 Claims, 5 Drawing Sheets

(56) References Cited

FOREIGN PATENT DOCUMENTS

| | | | |
|---|---|---|---|
| JP | 2003-239880 | A | 8/2003 |
| JP | 2004-060532 | | 2/2004 |
| JP | 2004-225583 | A | 8/2004 |
| JP | 2005-240774 | | 9/2005 |

OTHER PUBLICATIONS

United States Office Action issued in U.S. Appl. No. 12/709,051 dated Mar. 26, 2012.

Japanese Office Action, and English translation thereof, issued in Japanese Patent Application No. 2009-037445 dated Jan. 22, 2013.

Japanese Office Action, and English translation thereof, issued in Japanese Patent Application No. 2009-037444 dated Jan. 22, 2013.

US Office Action issued in corresponding U.S. Appl. No. 12/709,100 dated Oct. 17, 2012.

Office Action issued in corresponding U.S. Appl. No. 12/709,100, dated Jun. 7, 2013.

Notice of Allowance issued in corresponding U.S. Appl. No. 12/709,100, dated Aug. 20, 2013.

* cited by examiner

SCROLL TYPE COMPRESSOR HAVING AN INTERCOMMUNICATION PATH IN WHICH A PIN MEMBER IS INSERTED

INCORPORATION BY REFERENCE

The present application claims priority under 35 U.S.C. §119 to Japanese Patent Application No. 2009-037445 filed on Feb. 20, 2009. The content of the application is incorporated herein by reference in its entirety.

BACKGROUND OF THE INVENTION

1. Field of the Invention

The present invention relates to a scroll type compressor having an oil path through which lubricating oil is supplied to engagement portions at a low-pressure side between a fixed scroll and a movable scroll.

2. Description of the Related Art

There is known a scroll type compressor in which a fixed scroll and a movable scroll engaged with the fixed scroll are accommodated in a hermetically sealed container. In this type of scroll compressors, there has been proposed a scroll type compressor which has an oil path for supplying lubricating oil to an engagement portion at the low-pressure side between the fixed scroll and the movable scroll, and a flow rate restricting member which has a main body having a spiral passage formed on the outer periphery thereof and is disposed in the oil path (see JP-A-2004-60532, for example).

In the construction disclosed in the above publication, the restriction of the flow rate is dependent on the size of the spiral passage formed on the outer periphery of the main body, and thus the processing precision (machining performance) of the spiral passage has been required to be high, so that it has been difficult to process the spiral passage.

SUMMARY OF THE INVENTION

Therefore, an object of the present invention is to provide a scroll type compressor that can restrict the flow rate of lubricating oil without requiring a high processing precision and can be manufactured in low cost.

In order to attain the above object, there is provided a scroll type compressor comprising: a fixed scroll; a movable scroll engaged with the fixed scroll; and a hermetically sealed container in which the fixed scroll and the movable scroll are mounted, wherein one scroll of the fixed scroll and the movable scroll includes: an intercommunication path that is opened to the outside of the one scroll at one end thereof, extends substantially in a radial direction of the one scroll, has a high-pressure opening intercommunicating with a high-pressure portion of the hermetically sealed container and a low-pressure opening intercommunicating with a low-pressure portion in the one scroll, and has a lower hole opened to the outside of the one scroll and an insertion hole formed by subjecting the lower hole to reaming processing from the one end to a position of a predetermined depth of the lower hole, oil being supplied from the high-pressure opening through the inside of the intercommunication path to the low-pressure opening; a pin member that is configured to be slightly smaller in diameter than the intercommunication path and movably inserted in the intercommunication path; and a screw member that is provided at one end of the intercommunication path to close the one end of the intercommunication path so as to press the pin member against the end of the back side of the intercommunication path.

According to the present invention, the intercommunication path is constructed by forming the lower hole opened to the outside at one end thereof and then executing reaming processing (reamer processing) on the lower hole till the position of the predetermined depth to form the insertion hole. Therefore, the surface roughness of the inner surface of the insertion hole can be reduced (that is, the smoothness of the inner surface can be enhanced), and thus the gap between the inner diameter of the insertion hole and the outer diameter of the pin member inserted in the insertion hole can be remarkably properly managed. Therefore, the flow rate of the lubricating oil directing from the high-pressure side to the low-pressure side can be properly regulated (restricted).

Furthermore, in this construction, it is unnecessary to process the pin member, and thus when it is deigned in a cylindrical shape, a cylindrical pin member can be used as it is without processing the pin member. Therefore, the scroll type compressor is not dependent on the processing precision, and the manufacturing cost of the pin member can be reduced.

In this case, the pin member may comprise a first pin fitted in the lower hole at the back side of the intercommunication path, and a second pin that is brought into contact with the first pin and fitted in the insertion hole.

According to this construction, a channel through which lubricating oil flows may be formed in the gap between the lower hole and the first pin fitted in the lower hole, and the size of the gap does not so much contribute to the regulation (restriction) of the flow rate. On the other hand, the size of the gap between the insertion hole and the second pin fitted in the insertion hole greatly contributes to the regulation (restriction) of the flow rate. In this construction, the insertion hole is finished by the reaming (reamer) processing, and thus the finishing precision of the inner diameter of the insertion hole is enhanced. Thereby, by merely inserting the pin member, the gap between the inner diameter of the insertion hole and the outer diameter of the pin member inserted in the insertion hole can be remarkably properly managed. Accordingly, the flow rate of the lubricating oil flowing from the high-pressure side to the low-pressure side can be properly regulated (restricted) can be properly regulated (restricted) by the gap concerned.

Furthermore, in the above construction, it is unnecessary to process the pin member, and when the original shape of the pin member is cylindrical, the pin member can be directly used without modifying the shape. Therefore, it is not dependent on the processing precision, and also the manufacturing cost of the pin member can be reduced.

The first pin and the second pin may be integrated with each other.

In this construction, the number of parts of the pin member can be reduced, and also the assembly of the parts and the exchange of the pin member can be easily performed. In the case of the drill processing, the substantially conical processing trace of the tip of the drill is left at the end of the back side of the lower hole described above. Accordingly, if the substantially conical tip portion fitted to the processing trace is formed at the tip of the first pin 155A of the integrated pin member 155, when the pin member 155 is inserted into the intercommunication hole 51 and the screw member is screwed into the intercommunication hole, the intercommunication hole and the pin member can be easily set to be coaxial with each other, and the gap between the inner diameter of the insertion hole and the outer diameter of the second portion can be properly managed. Accordingly, the flow rate of the lubricating oil directing from the high-pressure side to the low-pressure side can be properly regulated (restricted) by the gap.

DETAILED DESCRIPTION OF THE PREFERRED EMBODIMENT

A preferred embodiment according to the present invention will be described hereunder with reference to the accompanying drawings.

Figure 1:
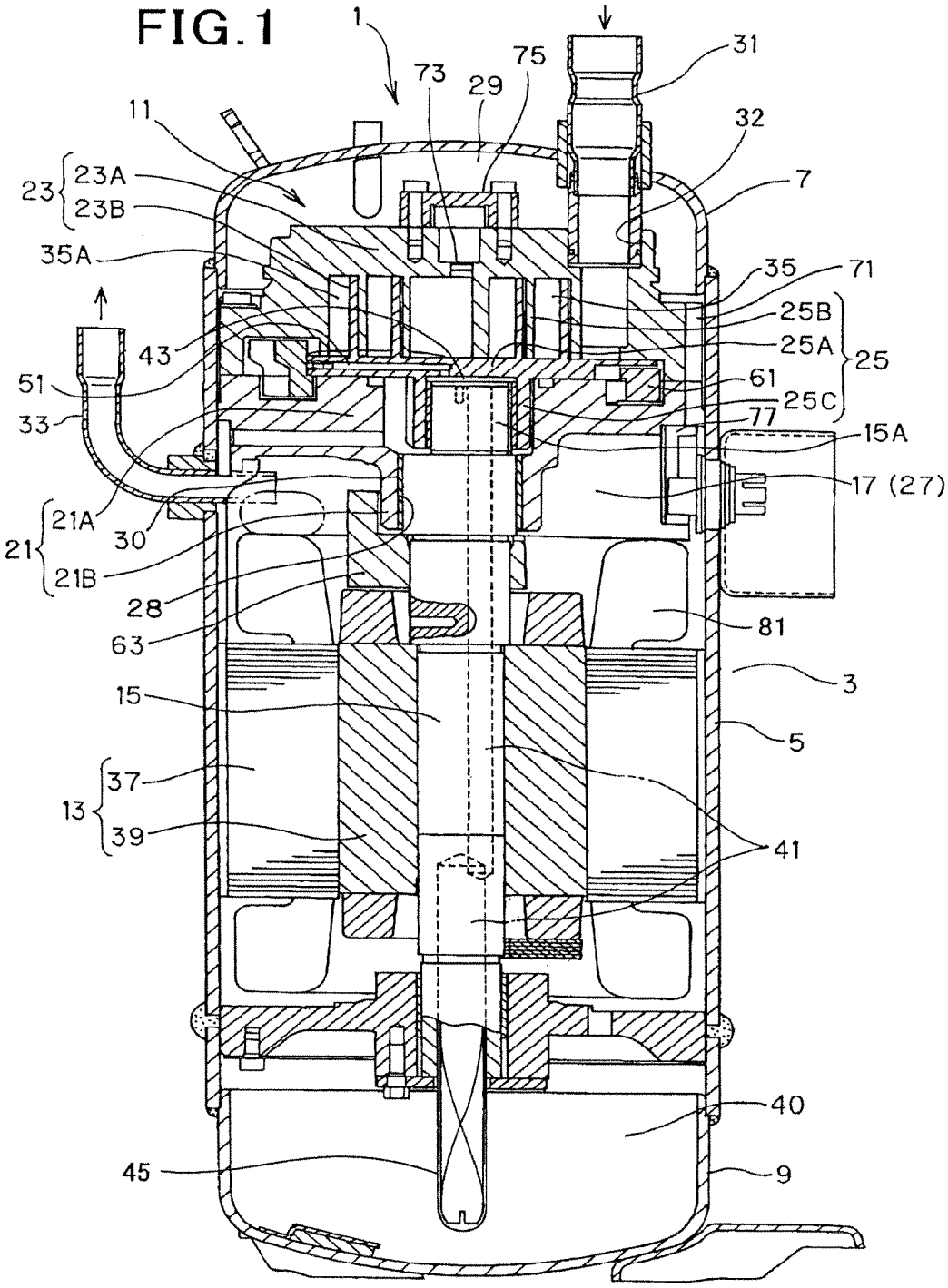
FIG. 1 is a cross-sectional view showing an embodiment of the present invention.

In FIG. 1, reference numeral 1 represents a scroll type compressor having a high internal pressure. The compressor 1 is connected to a refrigerant circuit (not shown) in which refrigerant is circulated to perform a refrigeration cycle operation, and compresses the refrigerant. The compressor 1 has a hermetically-sealed dome type casing 3 which is designed in an elongated cylindrical shape.

The casing 3 is constructed as a pressure container by a casing main body 5 as a cylindrical body portion having an axis line in the up-and-down direction, a saucer-shaped upper cap 7 which is air-tightly welded and integrally joined to the upper end portion of the casing main body 5 and has an upwardly projecting convex surface, and a saucer-shaped lower cap 7 having a downwardly projecting convex surface, and the inside of the casing 3 is designed to have a cavity.

A scroll compression mechanism 11 for compressing refrigerant, and a driving motor 13 disposed below the scroll compression mechanism 11 are mounted in the casing 3. The scroll compression mechanism 11 and the driving motor 13 are connected to each other through a driving shaft 15 which is disposed so as to extend in the up-and-down direction in the casing 3. A gap space 17 is formed between the scroll compression mechanism 11 and the driving motor 13.

The scroll compression mechanism 11 has a housing 21 as a substantially cylindrical accommodating member which is opened at the upper side thereof and has a bottom, a fixed scroll 23 which is disposed in close contact with the upper surface of the housing 21, and a movable scroll 25 which is disposed between the fixed scroll 23 and the housing 21 and engaged with the fixed scroll 23. The housing 21 is press-fitted in the casing main body 5 over the whole outer peripheral surface thereof in the peripheral direction. The inside of the casing 3 is compartmented into a high pressure space 27 at the lower side of the housing 21 and a discharge space 29 at the upper side of the housing 21, and the respective spaces 27 and 29 intercommunicate with each other through a longitudinal groove (passage) 71 which is formed on the outer peripheries of the housing 21 and the fixed scroll 23 so as to extend longitudinally.

The housing 21 is provided with a housing space 21A in which an eccentric axial portion 15A of the driving shaft 15 is rotated, and a radial bearing portion 21B extending downwardly from the center of the lower surface of the housing 21. Furthermore, the housing 21 is provided with a radial bearing hole 28 penetrating between the lower end surface of the radial bearing portion 21B and the bottom surface of the housing space 21A, and the upper end portion of the driving shaft 15 is rotatably fitted and mounted through the radial bearing 30 in the radial bearing hole 28. A suction pipe 31 for leading the refrigerant in the refrigerant circuit to the scroll compression mechanism 11 penetrates through the upper cap 7 of the casing 3 and is air-tightly fixed to the upper cap 7, and a discharge pipe 33 for discharging the refrigerant in the casing 3 to the outside of the casing 3 penetrates through the casing main body 5 and is air-tightly fixed to the casing main body 5. The suction pipe 31 extends in the up-and-down direction in the discharge space 29, and the inner end portion of the suction pipe 31 penetrates through a suction port 32 opened to the fixed scroll 23 of the scroll compression mechanism 11, and intercommunicates with the compression chamber 35. Accordingly, the refrigerant is sucked into the compression chamber 35 through the suction pipe 31.

The driving motor 13 has an annular stator 37 fixed to the inner wall surface of the casing 3, and a rotor 39 which is freely rotatably provided inside the stator 37, the motor 13 is constructed by a DC motor, and the movable scroll 25 of the scroll compression mechanism 11 is connected to the rotor 39 through the driving shaft 15.

The lower space 40 at the lower side of the driving motor 13 is kept to a high-pressure state, and oil is stocked at the inner bottom portion of the lower cap 9 corresponding to the lower end portion of the lower space 40. An oil supply path 41 as a part of a high-pressure oil supply unit is formed in the driving shaft 15, the oil supply path 41 intercommunicates with an oil chamber 43 at the back side of the movable scroll 25. A pickup 45 is connected to the lower end of the driving shaft 15, and the pickup 45 scoops up the oil stocked at the inner bottom portion of the lower cap 9. The scooped oil is passed through the oil supply path 41 of the driving shaft 15 and supplied to the oil chamber 43 at the back side of the movable scroll 25, and supplied from the oil chamber 43 to each sliding portion and the compression chamber 35 of the scroll compression mechanism 11 through an intercommunication path 51 provided to the movable scroll 25.

The fixed scroll 23 comprises a mirror plate 23A and a scroll-like (involute type) lap 23*b* formed on the lower surface of the mirror plate 23A. The movable scroll 25 comprises a mirror plate 25A and a scroll-type (involute type) lap 25B formed on the upper surface of the mirror plate 25A. The lap 23B of the fixed scroll 23 and the lap 25B of the movable scroll 25 are engaged with each other, whereby plural compression chambers 35 are formed by both the laps 23B and 25B between the fixed scroll 23 and the movable scroll 25.

The movable scroll 25 is supported through the Oldham's ring 61 by the fixed scroll 23, and a cylindrical boss portion 25C having a bottom is projected from the center portion of the lower surface of the mirror plate 25A. Furthermore, an eccentric shaft portion 15A is provided to the upper end of the driving shaft 15, and the eccentric shaft portion 15A is rotatably fitted in the boss portion 25C of the movable scroll 25.

Furthermore, a counter weight portion 63 is provided to the driving shaft 15 at the lower side of the radial bearing portion 21B of the housing 21 in order to establish dynamic balance with the movable scroll 25, the eccentric shaft portion 15A, etc. The driving shaft 15 rotates while keeping the weight balance by the counter weight portion 63, whereby the movable scroll 25 does not rotate on its axis, but swirls the compression chamber 35 is configured so that in connection with the swirling of the movable scroll 25, the refrigerant sucked by the suction pipe 31 is compressed due to contraction of the volume between both the laps 23B and 25B.

A discharge hole 73 is provided at the center portion of the fixed scroll 23, and gas refrigerant discharged from the discharge hole 73 is passed through the discharge valve 75 and discharged to the discharge space 29, and flows out into the high-pressure space 27 at the lower side of the housing 21 through a longitudinal groove 71 formed on the respective outer peripheries of the housing 21 and the fixed scroll 23. This high-pressure refrigerant is discharged to the outside of the casing 3 through the discharge pipe 33 provided to the casing main body 5.

A guide member (gas flow deflecting member) 77 is provided to the lower side of the longitudinal groove 71. The guide member 77 deflects the flow direction of the gas refrigerant (which is discharged from the discharge valve 75 to the discharge space 29, passed through the longitudinal groove 71 and flows downwardly) toward a shielding plate and/or in the horizontal direction along the inner surface of the casing main body 5 (casing 3), and also guides the gas refrigerant through a passage between the shielding plate at the upper side of the coil end 81 of the driving motor 13 and the inner surface of the casing main body 5 (casing 3) and then to the discharge pipe 33.

The driving operation of the scroll type compressor 1 described above will be described.

When the driving motor 13 is driven, the rotor 39 rotates relative to the stator 37, and thus the driving shaft 15 rotates. When the driving shaft 15 rotates, the movable scroll 25 of the scroll compression mechanism 11 does not rotate on its axis, but makes only the swirling motion relative to the fixed scroll 23. Accordingly, low-pressure refrigerant is passed through the suction pipe 31, and sucked from the peripheral edge side of the compression chamber 35 into the compression chamber 35, so that this refrigerant is compressed in connection with volume variation of the compression chamber 35. The compressed refrigerant is increased in pressure, passed from the compression chamber 35 to the discharge valve 75, and discharged to the discharge space 29. Further, the refrigerant is passed through the longitudinal groove 71 formed on the respective outer peripheries of the housing 21 and the fixed scroll 23, and then flows out to the high-pressure space at the lower side of the housing 21. Still further, this high-pressure refrigerant is discharged through the discharge pipe 33 provided to the casing main body 5 to the outside of the casing 3. After the refrigerant discharged to the outside of the casing 3 is circulated in the refrigerant circuit (not shown), the refrigerant is sucked through the suction pipe 31 into the compressor 1 again, and compressed in the compressor. The circulation of the refrigerant as described above is repeated.

The flow of oil will be described. Oil stocked in the inner bottom portion of the lower cap of the casing 3 is scooped up by the pickup 45 provided to the lower end of the driving shaft 15, and this oil is passed through an oil path 41 of the driving shaft 15, supplied to an oil chamber 43 at the back side of the movable scroll 25, and then supplied from the oil chamber 43 through an intercommunication path 51 provided to the movable scroll 25 to each of sliding portions of the scroll compressor mechanism 11 and the compression chamber 35.

Figure 2:
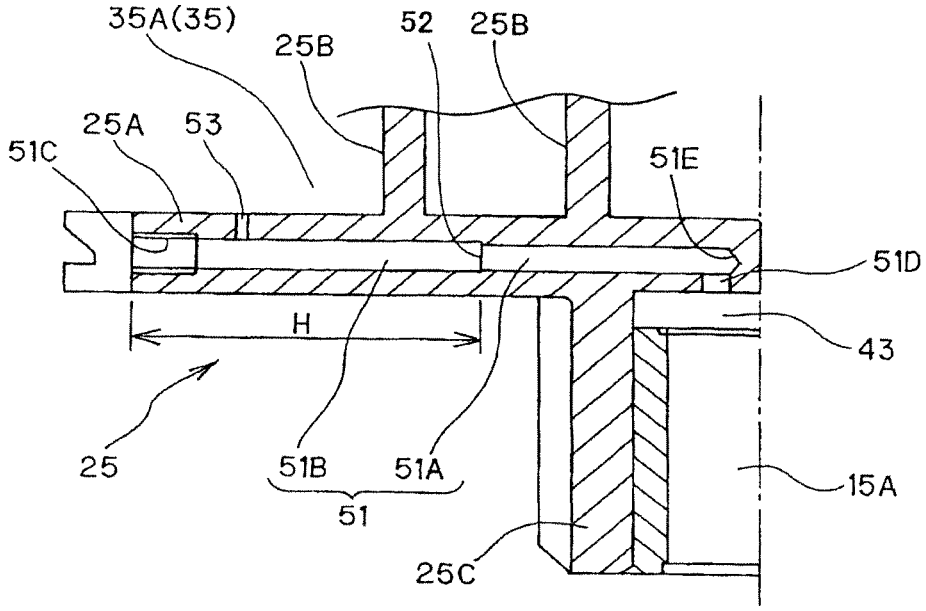
FIG. 2 is an enlarged cross-sectional view showing an intercommunication path provided in a scroll.

FIG. 2 is an enlarged view of the intercommunication path 51 provided to the movable scroll 25.

The mirror plate 25A of the movable scroll 25 is provided with the intercommunication path 51 which is opened outwardly at one end thereof and extends linearly (in a radial direction of the movable scroll 25) inwardly. The intercommunication path 51 is formed by first forming a lower hole 51A of an intercommunication path whose one end is opened outwardly. In the case of drill processing, a substantially conical processing trace 51E which is conformed with the tip of a drill in shape is left at the leading-edge of the lower hole 51A. Then, reaming processing is conducted from one end to a position of a predetermined depth H on the lower hole 51A to form an insertion hole 51B which extends to the predetermined depth H and has a lower surface roughness (i.e., higher smoothness) than the lower hole 51A. Accordingly, a minute step portion (stopper portion) 52 is formed at the rear end of the insertion hole 51B, that is, the boundary between the insertion hole 51B and the lower hole 51A. Furthermore, a female screw hole 51C is formed at an inlet port of the insertion hole 51B. The other end (high-pressure opening) of the intercommunication path 51 is bent in a substantially L-shape, and intercommunicates with the oil chamber (the high-pressure portion in the hermetically-sealed container) 43 at the backside of the movable scroll 25 described above. A low-pressure opening 53 is opened in the inner peripheral surface at the entrance side of the intercommunication path 51. The low-pressure opening 53 intercommunicates with the compression chamber (low-pressure portion 35A) at the outside which is formed between both the laps 23B and 25B of both the scrolls 23 and 25.

Figure 3:
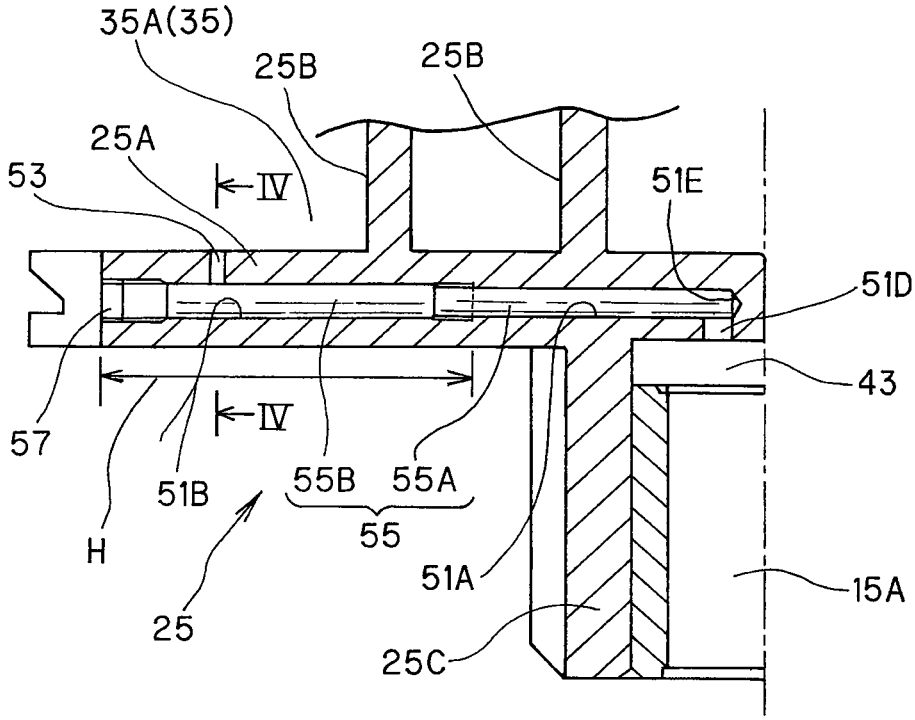
FIG. 3 is an enlarged cross-sectional view showing a state that a pin member is inserted into the intercommunication path.

FIG. 3 shows a state that a flow rate restricting member (pin member) 55 is inserted in the intercommunication path 51.

The pin member 55 has a first pin 55A fitted in the lower hole 51A at the back side of the intercommunication path 51, and a second pin 55B that is fitted in the insertion hole 51B at the front side of the intercommunication path 51 while abutting against the first pin 55A. A screw member 57 having a hexagonal hole is threaded in the screw hole 51C, and one end of the insertion hole 51B is closed by the screw member 57. The screw member 57 is fixed by adhesive agent or the like so as to prevent looseness of the screw member 57.

Figure 4:
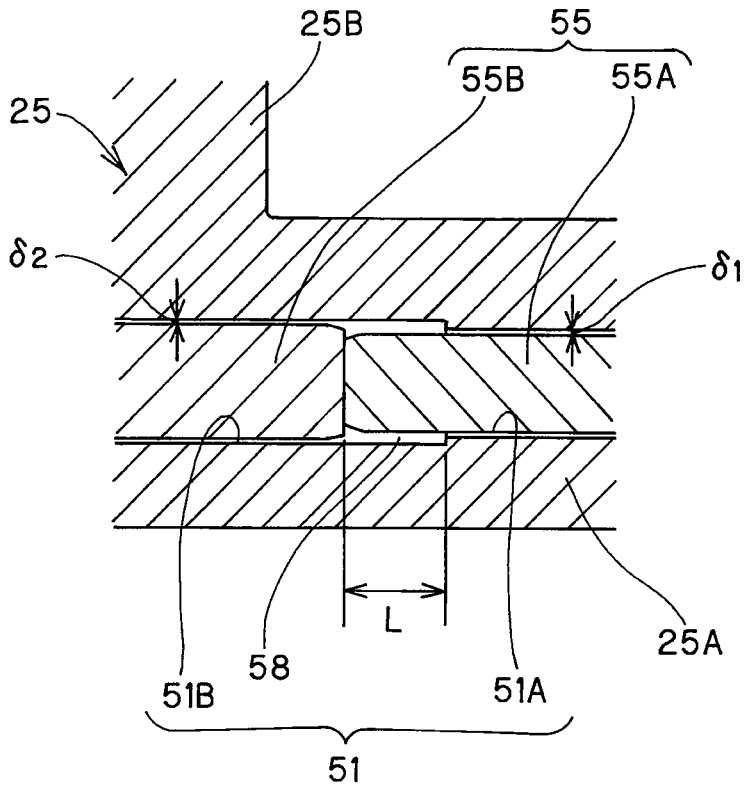
FIG. 4 is a cross-sectional view taken along IV-IV of FIG. 3.

FIG. 4 is an enlarged view showing the contact portion between the first pin 55A and the second pin 55B.

The insertion hole 51B constituting the intercommunication path 51 is subjected to finish processing by reaming processing, and the hole diameter of the insertion hole 51B is slightly larger than the lower hole 51A, the finishing precision of the inner surface of the insertion hole 51B is high. On the other hand, the lower hole 51A is subjected to drill processing, and thus the finishing precision of the inner surface of the insertion hole 51A is low. The outer diameter of the first pin 55A is set to be smaller than the inner diameter of the lower hole 51A, and the outer diameter of the second pin 55B is slightly smaller than the inner diameter of the insertion hole 51B.

In this embodiment, the first pin 55A projects to the insertion hole 51B side by the length corresponding to the dimension L. Therefore, oil at the high-pressure side which flows to the left side of FIG. 4 through a gap $\delta 1$ between the lower hole 51A and the first pin 55A enters a pool portion 58 compartmented between the first pin 55A and the insertion hole 51B. Furthermore, the oil in the pool portion 58 passes through a gap $\delta 2$ between the insertion hole 51B and the second pin 55B and further flows to the left side of FIG. 4, so that the oil is finally sucked through the low-pressure opening 53 (FIG. 3) into the compression chamber 35 at the low-pressure side.

In this construction, it is unnecessary to strictly manage the gap $\delta 1$ between the lower hole 51A and the first pin 55A fitted in the lower hole 51A, and a channel through which oil flows may be formed. The size of the gap $\delta 1$ does not so much contribute the flow rate restriction. On the other hand, the gap $\delta 2$ between the insertion hole 51B and the second pin 55B fitted in the insertion hole 51B greatly contributes the flow rate restriction.

In this embodiment, the intercommunication path 51 is constructed by forming the lower hole 51A having one end opened to the outside of the scroll and then conducting reaming processing on the lower hole 51A from the one end to the position of a predetermined depth H in the lower hole 15A to form the insertion hole 51B. Therefore, the surface roughness of the insertion hole 51B can be reduced (i.e., the inner surface of the insertion hole 51B can be more smoothened), and the gap δ2 between the inner diameter of the insertion hole 51B and the outer diameter of the second pin 55B inserted in the insertion hole 51B can be remarkably properly managed. Accordingly, the flow rate of the lubricating oil flowing from the high-pressure side to the low-pressure side can be properly regulated (restricted) by exclusively adjusting the gap δ2 with high precision.

With this construction, it is unnecessary to process the second pin 55B, and when the second pin 55B is designed in a cylindrical shape, a cylindrical second pin 55B itself may be used without being processed. Accordingly, the pin member is not dependent on the processing precision, and the manufacturing cost of the pin member 155 can be reduced.

Figure 5:
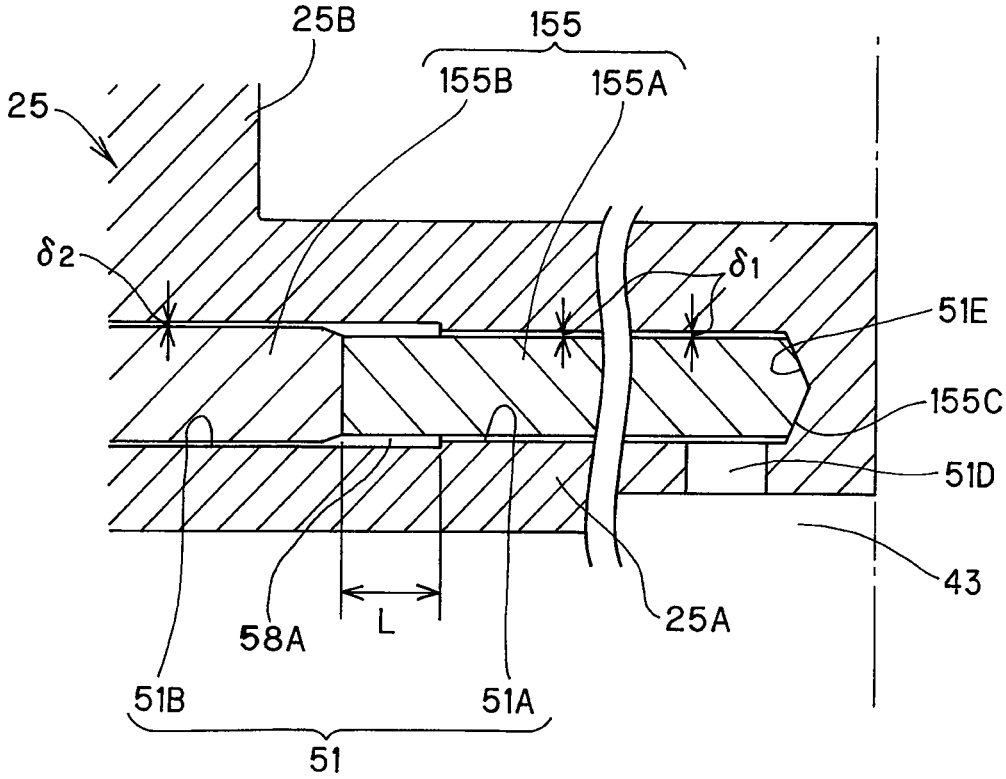
FIG. 5 is a diagram showing another embodiment of the pin member.

FIG. 5 shows another embodiment. In FIG. 5, the same elements as shown in FIG. 4 are represented by the same reference numerals, and the description thereof is omitted.

In this embodiment, the pin member 155 is integrally configured. That is, the pin member 155 is constructed by cutting the outer periphery of a first portion 155A at the back side with a second portion 155B at the front side set as a reference. The first portion 155A is fitted in the lower hole 51A at the back side of the intercommunication path 51, and the second portion 155B is fitted in the insertion hole 51B at the front side of the intercommunication path 51. In this construction, the tip portion 155C of the first portion 155A is formed in a conical shape, and the tip portion 155C is fitted to the conical processing trace 51E of the lower portion 51A.

According to the above construction, the number of parts of the pin member 155 can be reduced, and also the assembly of the parts and the exchange of the pin member 155 can be easily performed. In the case of the drill processing, the substantially conical processing trace 51E of the tip of the drill is left at the end of the back side of the lower hole 51A described above. Accordingly, if the substantially conical tip portion 155C fitted to the processing trace 51E is formed at the tip of the first pin 155A of the integrated pin member 155, when the pin member 155 is inserted into the intercommunication hole 51 and the screw member 57 is screwed into the intercommunication hole 51, the intercommunication hole 51 and the pin member 155 can be easily set to be coaxial with each other, and the gap δ between the inner diameter of the insertion hole 51B and the outer diameter of the second portion 155B can be properly managed.

The present invention is not limited to the above embodiment, and various modifications may be made without departing from the subject matter of the present invention.

For example, in the above embodiment, the mechanism of this invention is applied to the inside high-pressure type scroll compressor, however, this mechanism may be applied to an inside low-pressure type scroll compressor. In this case, the above intercommunication path is disposed at the fixed scroll side, and the flow rate restricting member (pin member) may be inserted in the intercommunication path.

What is claimed is:

1. A scroll type compressor comprising:

a fixed scroll;

a movable scroll engaged with the fixed scroll; and a hermetically sealed container in which the fixed scroll and the movable scroll are mounted, wherein one scroll of the fixed scroll and the movable scroll includes:

an intercommunication path that is opened to the outside of the one scroll at one end thereof, extends substantially in a radial direction of the one scroll, has a high-pressure opening intercommunicating with a high-pressure portion of the hermetically sealed container and a low-pressure opening intercommunicating with a low-pressure portion in the one scroll, and has a lower hole communicating with the high-pressure opening and an insertion hole communicating with the low-pressure opening;

a pin member that is configured to be slightly smaller in diameter than the intercommunication path and movably inserted in the intercommunication path so as to form a channel through which oil flows in a gap between the intercommunication path and the pin member inserted in the intercommunication path, the oil being supplied from the high-pressure opening through the channel to the low-pressure opening; and a screw member that is provided at one end of the intercommunication path to close the one end of the intercommunication path so as to press the pin member against the end of the back side of the intercommunication path, and the insertion hole has a larger diameter than the lower hole.

2. The scroll type compressor according to claim 1, wherein the pin member comprises a first pin fitted in the lower hole at the back side of the intercommunication path, and a second pin that is brought into contact with the first pin and fitted in the insertion hole.

3. The scroll type compressor according to claim 2, wherein the first pin and the second pin are integrated with each other.

4. The scroll type compressor according to claim 3, wherein the first pin is longer than a depth of the lower hole.

5. The scroll type compressor according to claim 3, wherein a diameter of the first pin is smaller than a diameter of the second pin.

6. The scroll type compressor according to claim 2, wherein the first pin is longer than a depth of the lower hole.

7. The scroll type compressor according to claim 2, wherein a diameter of the first pin is smaller than a diameter of the second pin.

8. The scroll type compressor according to claim 1, wherein an inner surface of the insertion hole has a lower surface roughness than an inner surface of the lower hole.

9. The scroll type compressor according to claim 1, wherein the lower hole is opened to the outside of the one scroll.

10. The scroll type compressor according to claim 1, wherein the insertion hole is formed by subjecting the lower hole to reaming processing from the one end to a position of a predetermined depth of the lower hole.

* * * * *